US007473510B2

(12) United States Patent
Tomoyori et al.

(10) Patent No.: US 7,473,510 B2
(45) **Date of Patent: *Jan. 6, 2009**

(54) ELECTROPHOTOGRAPHIC PHOTORECEPTOR, A PROCESSING CARTRIDGE, AN IMAGE FORMING APPARATUS AND AN IMAGE FORMING METHOD

(75) Inventors: Kageyuki Tomoyori, Hachioji (JP); Hirofumi Hayata, Fuchu (JP); Tomoo Sakimura, Hino (JP); Tsuyoshi Shimoda, Musashino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 265 days.

This patent is subject to a terminal disclaimer.

(21) Appl. No.: 10/886,770

(22) Filed: Jul. 7, 2004

(65) Prior Publication Data

US 2005/0019683 A1 Jan. 27, 2005

(30) Foreign Application Priority Data

Jul. 22, 2003 (JP) ..... 2003-199549

(51) Int. Cl.
*G03G 13/22* (2006.01)
*G03G 5/14* (2006.01)

(52) U.S. Cl. ..... 430/123.43; 430/60; 430/64; 430/65; 430/123.4

(58) Field of Classification Search ..... 430/60, 430/62, 63, 64, 65, 120, 123.4, 123.43, 58.05
See application file for complete search history.

(56) References Cited

U.S. PATENT DOCUMENTS

| | | | | |
|---|---|---|---|---|
| 5,155,000 | A * | 10/1992 | Matsumura et al. | 430/108.6 |
| 5,430,526 | A * | 7/1995 | Ohkubo et al. | 399/159 |
| 5,744,271 | A * | 4/1998 | Aizawa et al. | 430/59.6 |
| 5,763,127 | A | 6/1998 | Goshima et al. | |
| 5,965,311 | A * | 10/1999 | Suzuki | 430/60 |
| 6,322,940 | B1 * | 11/2001 | Nishigaki et al. | 430/58.65 |
| 6,355,390 | B1 * | 3/2002 | Yamanami et al. | 430/60 |
| 6,399,263 | B1 * | 6/2002 | Hayata | 430/63 |
| 6,531,231 | B1 * | 3/2003 | Ito et al. | 428/500 |
| 7,166,398 | B2 * | 1/2007 | Itami et al. | 430/60 |
| 2003/0118927 | A1 * | 6/2003 | Nakamura et al. | 430/65 |
| 2004/0259009 | A1 * | 12/2004 | Itami et al. | 430/60 |

FOREIGN PATENT DOCUMENTS

| | | | |
|---|---|---|---|
| JP | 05-080567 | A | 4/1993 |
| JP | 9-43886 | A | 2/1997 |
| JP | 09-166882 | | 6/1997 |
| JP | 09-258468 | | 10/1997 |
| JP | 2000-221719 | A * | 8/2000 |
| JP | 2002-107983 | | 4/2002 |
| JP | 2003-149845 | | 5/2003 |
| JP | 2004-101800 | * | 4/2004 |

OTHER PUBLICATIONS

USPTO English-language translation of JP 2000-221719A (pub. Aug. 2000).*
Japanese Patent Office machine-assisted translation of JP 2004-101800 (pub. Apr. 2004).*
Grant, R., et al., ed., *Grant & Hackh's Chemical Dictionary*, Fifth Edition, McGraw-Hill Book Company, NY (1987), pp. 276 and 330.*
Neufeldt, V., et al., *Webster's New World Dictionary*, Third College Edition, Webster's New World, NY (1988), p. 548.*
USPTO English-language translation of JP 09-166882 (pub. Jun. 1997).*

* cited by examiner

*Primary Examiner*—Janis L Dote
(74) *Attorney, Agent, or Firm*—Frishauf, Holtz, Goodman & Chick, P.C.

(57) ABSTRACT

An electrophotographic photoreceptor to be used in an image forming apparatus having a charge providing means by contacting a charging member to an electrophotographic photoreceptor is disclosed. The photoreceptor has at least an interlayer, a charge generation layer and a charge transfer layer each provided on an electroconductive substrate, and the interlayer has a thickness of from 5 to 25 μm and the charge transfer layer has a thickness of from 5 to 20 μm. An image forming apparatus, image forming method and cartridge for the method are also disclosed.

15 Claims, 2 Drawing Sheets

ELECTROPHOTOGRAPHIC PHOTORECEPTOR, A PROCESSING CARTRIDGE, AN IMAGE FORMING APPARATUS AND AN IMAGE FORMING METHOD

FIELD OF THE INVENTION

The present invention relates to an electrophotographic photoreceptor, a processing cartridge, an image forming apparatus and an image forming method to be employed for image forming by an electrophotographic system, and relates in detail to an electrophotographic photoreceptor, a processing cartridge, an image forming apparatus and an image forming method to be employed for image forming by an electrophotographic system to be applied in the field of copying machines and printers.

Recently, organic photoreceptors are become as the main stream of the electrophotographic photoreceptor since the organic photoreceptors have merits such as wider selection extent, higher environmental suitability and lower production cost compared with inorganic photoreceptors.

In the image forming method based on Carlson method, an electrophotographic photoreceptor is charged, an electrostatic latent image is formed, a toner image is formed, the toner image is transferred onto the image receiving paper and the image is fixed to form the final image.

A corona discharge device has been known as the charging device. The corona discharge device has a merit of that the charging can be stably performed by it. The corona discharge device, however, causes generation of ionized oxygen, ozone, humid and a nitrogen oxide compound because of that high voltage is applied to the device. Such the generated substances cause problems such as degradation of the organic photoreceptor, hereinafter referred to as the photoreceptor.

Consequently, it is investigated in recent years to apply a contact charging method without employing any corona discharge device. In concrete, a magnetic brush or an electroconductive roller as the charging device to which voltage is applied is contacted to the photoreceptor to be charged for giving a designated potential to the surface of the photoreceptor. The voltage can be lowered by the employing of the contact charging method compared to the non-contact charging method using the corona discharge device so as to reduce the generation amount of ozone.

The contact charging method is a method in which a direct current or a direct current overlapped with an alternative current is applied to a charging member having a electric resistivity of approximately from $10^2$ to $10^{10}$ Ω·cm and the charging member is contacted by pressure to the photoreceptor to giving the electrostatic potential to the photoreceptor. In this charging method, the voltage applied to the charging member is lower than that in the corona charging method and the generation amounts of ozone and nitrogen oxide compound are reduced.

However, cracks and stains are formed on the electrophotographic photoreceptor when the surface of the photoreceptor is repeatedly charged by the direct contact with the charging roller. As a result of that, the charge is concentrated at the cracks and the stains, and image defects such as dielectric breakdown and black spots formation tend to be caused and spreading of image tends to occur. Particularly, such the problems easily occur under serious conditions such as high temperature and high humidity, and low temperature and low humidity.

It is proposed for preventing the occurrence of the image defects such as the dielectric breakdown and the formation of black spots to raise the resistivity of the photoreceptor to charge leaking by anodizing the surface of the aluminum substrate of the electroconductive support so that the leak of charge from the electroconductive substrate is prevented even when the cracks and the stains are formed on the photosensitive layer (cf. Patent publication 1).

However, the electrophotographic photoreceptor employing the anodized aluminum substrate has problems such as that the charge leak preventing effect is unstably obtained by degradation of the anodized layer depending on the slight variation of the conditions of the anodizing treatment and the storage thereafter, and that the interface between the anodized layer and the photosensitive layer is easily become a charge trapping site and the remaining potential is gradually raised accompanied with using for a prolonged period.

(Patent Publication 1)

Japanese Patent Publication Open to Public Inspection No. 5-080567

SUMMARY OF THE INVENTION

The present invention provides an electrophotographic photoreceptor, a processing cartridge, an image forming apparatus and an image forming method capable of forming an image stably for a prolonged period, in which the generation amount of ozone and nitrogen oxide compound and the charging method employing low voltage is utilized.

The object of the invention is to provide an electrophotographic photoreceptor, a processing cartridge, an image forming apparatus and an image forming method capable of stably forming an image with high sharpness for a prolonged period by preventing the degradation of the electrophotographic properties such as the sensitivity and the remaining potential and the occurrence of the image defects such as the dielectric breakdown and the black spots formation.

The inventors have found that it is important for solving the foregoing problems that the thickness of an insulating interlayer is made large and a photosensitive layer, particularly a charge transfer layer, provided on the interlayer is made not so thick.

The invention and preferable embodiments are described.

A method of forming a toner image, comprising steps of:

electrically charging an electrophotographic photoreceptor by contacting a charging means to the photoreceptor;

imagewise exposing the photoreceptor so that a latent image is formed on the photoreceptor; and developing the latent image with toner so that a toner image is formed on the photoreceptor;

wherein the photoreceptor comprises an interlayer with a thickness of from 5 to 25 μm, a charge generation layer and a charge transfer layer with a thickness of from 5 to 20 μm each provided on an electroconductive substrate.

An electrophotographic photoreceptor to be used in an image forming apparatus having a charge providing means by contacting a charging member to the photoreceptor which has at least an interlayer, a charge generation layer and a charge transfer layer each provided on an electroconductive substrate, and the interlayer has a thickness of from 5 to 25 μm and the charge transfer layer has a thickness of from 5 to 20 μm.

A processing cartridge comprising an electrophotographic photoreceptor; and a charging device to electrically charging the photoreceptor by contacting to the photoreceptor;

wherein the photoreceptor comprises an interlayer with a thickness of from 5 to 25 μm, a charge generation layer and a charge transfer layer with a thickness of from 5 to 20 μm each provided on an electroconductive substrate.

An image forming apparatus having a charge providing means by contacting a charging member to the photoreceptor, in which the electrophotographic photoreceptor has at least an interlayer with a thickness of from 5 to 25 μm, a charge generation layer and a charge transfer layer with a thickness of from 5 to 20 μm each provided on an electroconductive substrate.

An electrophotographic photoreceptor to be used in an image forming apparatus having a charge providing means by contacting a charging member to an electrophotographic photoreceptor which has at least an interlayer, a charge generation layer and a charge transfer layer each provided on an electroconductive substrate, and the interlayer contains a metal oxide particle and has a thickness of from 5 to 25 μm and the charge transfer layer has a thickness of from 5 to 20 μm.

The metal oxide particle is preferably $TiO_2$, $ZrO_2$, ZnO or $Al_2O_3$.

The $TiO_2$ particle is preferably anatase type titanium oxide.

The anatase type titanium oxide preferably contains niobium element in an amount of from 100 ppm to 2.0% by weight.

The number average diameter of the primary particles of the metal oxide is preferably from 4 to 400 nm.

The interlayer preferably contains polyamide resin having a heat of fusion of from 0 to 40 J/g and a water absorption degree of not more than 5% by weight.

The interlayer preferably has a volume electric resistivity of not less than $10^8$ Ω·cm.

The thickness of the interlayer is preferably from 7 to 15 μm.

A processing cartridge to be used in an image forming apparatus having a charge providing means by contacting a charging member to an electrophotographic photoreceptor, in which an electrophotographic photoreceptor having at least an interlayer with a thickness of from 5 to 25 μm, a charge generation layer and a charge transfer layer with a thickness of from 5 to 20 μm each provided on an electroconductive substrate, a means for uniformly charging the surface of the electrophotographic photoreceptor, and at least one of a means for developing a electrostatic latent image formed on the electrophotographic photoreceptor and a means for transferring a toner image developed on the electrophotographic photoreceptor to a image receiving material are unitized so as to be freely installed to and released from the principal body of the image forming apparatus.

DETAILED DESCRIPTION OF THE INVENTION

Figure 1:
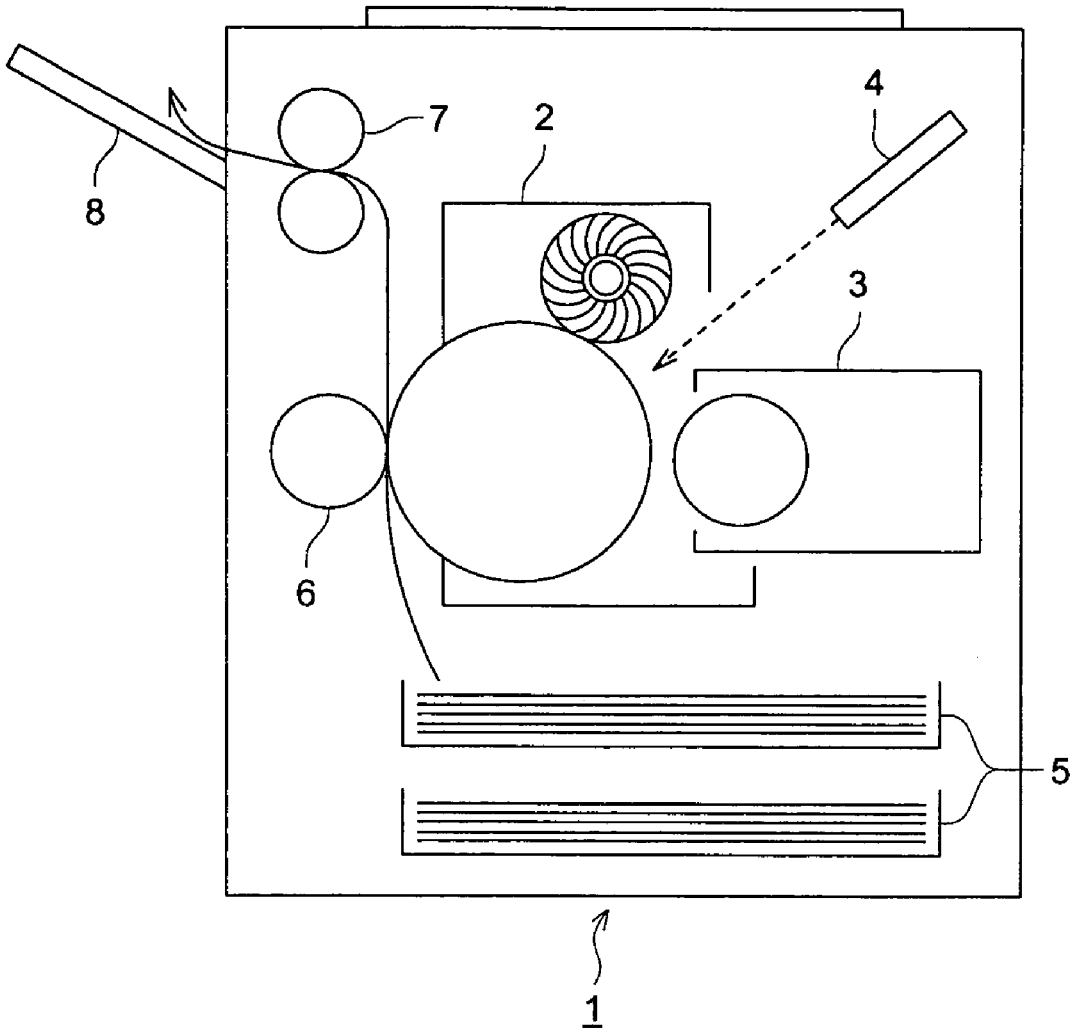
FIG. 1 is a schematic cross section of Image forming apparatus 1 employing the contact charging system.

The invention is described in detail below.

The electrophotographic photoreceptor according to the invention comprises an electroconductive substrate and at least an interlayer, a charge generation layer and a charge transfer layer provided on the electroconductive substrate and the interlayer has a thickness of from 5 to 25 μm, and the charge transfer layer has a thickness of from 5 to 20 μm.

The electrophotographic photoreceptor according to the invention comprises an electroconductive substrate and at least an interlayer, a charge generation layer and a charge transfer layer provided on the electroconductive substrate and the interlayer contains a metal oxide particle and has a thickness of from 5 to 25 μm, and the charge transfer layer has a thickness of from 5 to 20 μm.

The dielectric breakdown and the formation of black spots, which tend to occur in the image forming apparatus having the means for charging the electrophotographic photoreceptor by contacting the charging member to the photoreceptor, and the degradation of the photographic properties such as the sensitivity and the remaining potential can be prevented by the electrophotographic photoreceptor according to the invention and the image formation can be stably performed for a prolonged period.

The electrophotographic photoreceptor according to the invention is described below.

On the electrophotographic photoreceptor employed in the contact charging system, the charge tends to be concentrated to the crack and the stain formed on the electrophotographic photoreceptor. As a result of that, the image defects such as the dielectric breakdown and black spot formation tend to be caused and the image spreading is also tends to occur. To prevent the concentration of charge as the characteristic of the contact charging, it is important to prevent the leakage of the charge even if the cracks and the stains occur on the photoreceptor surface by reduce the strength of the electric field per unit thickness of the layer. For reducing the electro field strength per unit layer thickness, the electrophotographic photoreceptor is employed which comprises at least the interlayer with a thickness of from 5 to 25 μm, the charge generation layer and a charge transfer layer with a thickness of from 5 to 20 μm, each provided on the electroconductive substrate. The electric field strength is reduced so that the dielectric breakdown and the black spot formation are prevented and the remaining potential and the charged potential are stabilized by such the photoreceptor. Thus a sharp image can be resulted.

The thickness of the interlayer is more preferably from 7 to 15 μm for preventing the dielectric breakdown and the black spot formation and inhibiting the image spreading and the degradation of the sharpness of the image, and the thickness of the charge transfer layer is more preferably from 8 to 18 μm for preventing the dielectric breakdown and the black spot formation and inhibiting the image spreading and the degradation of the sharpness of the image.

The interlayer preferably contains a metal oxide particle. Examples of preferable metal oxide include cerium oxide, chromium oxide, aluminum oxide, magnesium oxide, zinc oxide, silicon oxide, tin oxide, zirconium oxide, iron oxide and titanium oxide. Among them, titanium oxide $TiO_2$, zinc oxide $ZnO_2$, aluminum oxide $Al_2O_3$ and zirconium oxide $ZrO_2$ are preferable, and titanium oxide is particularly preferred.

The metal oxide particle is preferably hydrophobilized by a hydrophobilizing agent such as a titanium coupling agent, a silane coupling agent, a high molecular fatty acid and a metal salt thereof.

The image defects such as the dielectric breakdown and the black spot formation tend to occur by the contact charging and the image spreading can be prevented and the electrophotographic photoreceptor having the stable properties for a prolonged period can be obtained by the addition of the metal oxide particle into the interlayer.

The metal oxide particle is preferably fine particles having a number average diameter of primary particle of from 5 to 400 nm. The number average diameter of primary particles is defined by the value measured as the average diameter in the fere direction by image analysis of 100 particles randomly selected from the electron microscopic photograph of the fine particles with a magnification of 10,000.

The type of titanium oxide particle includes anatase type, rutile type, bruckite type and amorphous type, and the anatase type is most preferred.

Anatase type titanium oxide containing niobium element in an amount of from 100 ppm to 2.0% by weight is preferable. The rectification ability of titanium oxide is stably displayed through a long using period of the photoreceptor by the addition of niobium element and the dielectric breakdown and the black spot are prevented and the variation of the charging property and the light-sensitivity sensitivity of the photoreceptor is small even when the environmental conditions of temperature and humidity are varied.

The content of niobium element is more preferably for 300 ppm to 1.8% by weight.

The concentration of niobium element in the anatase type titanium oxide can be measured by quantitative analysis by ICP (inductively coupled plasma light emission analysis method).

The anatase type titanium oxide can be prepared by a sulfuric acid method. A solution containing titanium sulfate or titanyl sulfate was heated for prepare a hydrated titanium dioxide slurry by hydrolysis, and the titanium dioxide slurry is dehydrated by baking to obtain the anatase type titanium oxide. Preparation method of the anatase type titanium oxide containing niobium element is described below.

Niobium sulfate is added to hydrate titanium dioxide slurry obtained by hydrolysis of an aqueous solution of titanyl sulfate. Suitable adding amount of niobium is from 0.15 to 5% by weight in terms of niobium ion to the amount of the titanium in terms of titanium dioxide. In concrete, (i) a hydrated titanium dioxide slurry obtained by hydrolysis of an aqueous solution of titanyl sulfate to which 0.15 to 5% by weight of niobium sulfate in terms of niobium ions or (ii) a hydrate titanium dioxide slurry obtained by hydrolysis of an aqueous solution of titanyl sulfate to which 0.15 to 5% by weight of niobium sulfate in terms niobium ions is added, may be employed.

The hydrated titanium dioxide slurry is dehydrated and baked. Suitable baking temperature is usually from 850 to 1,100° C. The anatase type titanium oxide can be obtained by such the method, which has an average diameter of the primary particles of from 0.01 to 10 μm and contains niobium element in an amount of from 100 ppm to 2% by weight of.

There is a way for preparing titanium oxide by a gas burning method using titanium tetrachloride. In such the case, anatase type titanium oxide containing no or almost no another metal element such as niobium can be obtained if any metal halide component is not brought.

The anatase ratio of the anatase type titanium oxide is preferably fro 90 to 100%. The anatase type titanium oxide having the anatase ratio of almost 100% can be prepared by the foregoing methods. The interlayer has rectification property can be suitably and stably obtained since the interlayer contains the anatase type titanium oxide containing niobium element.

The anatase ratio is a value defined according to the following equation based on the measuring results of the intensity IA of the strongest diffraction line of anatase (face index of 101) and the intensity IR of the strongest diffraction line of rutile (face index of 110).

$$\text{Anatase ratio (\%)}=100/(1+1.265\times IR/IA)$$

For preparing the titanium oxide having an anatase ratio of from 90 to 100%, the anatase type titanium oxide having an anatase ratio of almost 100% can be obtained by hydrolysis by heating of a solution containing titanium sulfate or titanyl sulfate as titanium compound. Titanium oxide having high anatase ratio can be obtained by neutralizing an aqueous solution of titanium tetrachloride by an alkali.

It is preferable that the anatase type titanium oxide is subjected to a surface treatment by a reactive organic silicon compound. The surface treatment of the anatase type titanium oxide by the reactive organic silicon compound can be performed by the following wet method. The surface treatment by the reactive organic silicon compound is performed by a treating solution employing a reactive organic silicon compound.

The anatase type titanium oxide is added to a liquid composed of an organic solvent or water in which the reactive organic silicon compound is dissolved or dispersed, and the resultant mixture is dispersed for a period of from several minutes to about 24 hours. The dispersion is subjected to heating treatment according to the case. Then the titanium oxide is filtered and dried to obtain the anatase type titanium oxide coated with the organic silicon compound. The reactive organic silicon compound may be added to the dispersion composed of the organic solvent or water in which the titanium oxide is dispersed.

The amount of the reactive organic silicon compound to be employed for the surface treatment is from 0.1 to 10, and preferably from 0.1 to 5, parts by weight to 100 parts by weight of the anatase type titanium oxide on the occasion of the surface treatment. By such the treatment, sufficient rectification effect, dispersing ability, photographic properties, remaining potential and charging potential can be obtained.

Examples of the reactive organic silicon compound are ones represented by the following Formula 1. The compound is not limited to the followings as long as the compound is capable of condensing reacting with the reactive group at the surface of titanium oxide such as a hydroxyl group.

$$(R)_n\text{—Si-}(A)_{4-n} \qquad \text{Formula 1}$$

In the above formula, Si is a silicon atom, R is an organic group directly bonded to the silicon atom, A is a hydrolysable group and n is an integer of from 0 to 3.

Examples of the organic group represented by R which is directly bonded with the silicon include an alkyl group such as a methyl group, an ethyl group, a propyl group, a butyl group, a pentyl group, an octyl group and a dodecyl group; an aryl group such as a phenyl group, a tolyl group, a naphthyl group and a biphenyl group; an epoxy-containing group such as a γ-glycidoxypropyl group and β-(3,4-epoxycyclohexyl) ethyl group; a (meth)acryloyl-containing group such as a γ-acryloxypropyl group and a γ-methacryloxypropyl group, a hydroxyl-containing group such as a γ-hydroxypropyl group and a 2,3-dihydroxypropyloxypropyl group; a vinyl-containing group such as a vinyl group and a propenyl group; a mercapto-containing group such as a γ-mercaptopropyl group; an amino-containing group such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluorooctylethyl group; a nitro- or cyan-substituted alkyl group. Examples of the hydrolyzable group represented by A include an alkoxyl group such as a methoxy group and an ethoxy group, a halogen and an acyloxy group.

The organic silicon compounds represented by Formula 1 may be employed singly or in a combination of two or more kinds thereof.

In the organic silicon compound represented by Formula 1, plural groups each represented by R may be the same as or different from each other when n is 2 or more. Plural groups represented by A may be the same as or different from each other when n is 2 or more. When two or more kinds of the organic silicon compounds represented by Formula 1 are employed, groups each represented by R and A of the individual compounds may be the same as or different from each other.

Polysiloxane compounds are preferable as the reactive organic silicone compound. Methylhydrogenpolysiloxanes are particularly preferred. As such the compound, one having a molecular weight of from 1,000 to 20,000 is easily available and displays suitable black spot preventing effect.

Another one method for the surface treatment of the titanium oxide is carried out by the use of an organic silicon compound having a fluorine atom. The surface treatment using the organic silicon compound having a fluorine atom is preferably preformed by the wet method.

In the invention, it is confirmed that the surface of titanium oxide is covered by the reactive organic silicon compound by a combination of surface analysis method such as electron spectroscopy for chemical analysis (ESCA), Auger electron spectroscopy, secondary ion mass spectrometry (SIMS) and scatter reflection FI-IR.

Other than the above, the surface treatment may be performed by at least one selected from alumina, silica and zirconia.

The alumina, silica and zirconia treatments are each a treatment for separating alumina, silica and zirconia on the surface of the anatase type titanium oxide, respectively.

It is particularly preferred that the alumina treatment is performed at first and followed by the silica treatment, even though both of the treatments may be simultaneously applied. In the case of the alumina and silica treatments are separately applied, it is preferred that the amount of the silica is larger than that of the alumina.

The surface treatment of the titanium oxide by the metal oxide such as alumina, silica and zirconia can be performed by a wet method. For example, the surface treatment by the alumina, silica or zirconia can be performed as follows.

When the anatase type titanium oxide is employed, the titanium oxide particles having a number average premier particle diameter of 50 nm was dispersed in from 50 to 350 g of water to form aqueous slurry, and a water-soluble silicate or a water-soluble aluminum compound was added to the slurry. And then the slurry is neutralized by adding an alkali or an acid so as to separate silica or alumina onto the surface of the titanium oxide particle. Thereafter, the titanium oxide particles are filtered, washed and dried to obtain the objective surface treated titanium oxide. When sodium silicate is employed as the water-soluble silicate, the neutralization can be carried out by an acid such as sulfuric acid and hydrochloric acid. When aluminum sulfate is used as the water-soluble aluminum compound, the neutralization can be carried out by an alkali such as sodium hydroxide and potassium hydroxide.

The amount of the metal oxide to be used for the surface treatment is preferably from 0.1 to 50 parts, more preferably from 1 to 10 parts, by weight to 100 parts by weight of the titanium oxide in terms of the weight on the occasion of the start of the surface treatment. In the foregoing case using the alumina and silica for the surface treatment of the anatase type titanium oxide, it is preferably that the alumina and silica are each employed in an amount of from 1 to 10 parts by weight to 100 parts of the titanium oxide, respectively, and the amount of the silica is preferably larger than that of the alumina.

The interlayer according to the invention is substantially an insulation layer. The volume resistivity of the insulation layer is not less than $1\times10^{8}$ Ω·cm. By the interlayer having such the resistivity, sufficient charge blocking ability of the interlayer can be obtained and the occurrence of the black spots and the remaining potential of the photoreceptor are inhibited so that the remaining potential during the repeating of image formation is stabilized and good image can be obtained. The volume resistivity of the interlayer and the protective layer is preferably from $1\times10^{8}$ to $1\times10^{15}$ Ω·cm, more preferably from $1\times10^{9}$ to $1\times10^{14}$ Ω·cm, and further preferably from $2\times10^{9}$ to $1\times10^{13}$ Ω·cm. The volume resistivity can be measured as follows.

Measuring condition: According to JIS C2318-1975

Measuring apparatus: Hiresta IP manufactured by Mitsubishi Yuka Co., Ltd.

Measuring condition: Measuring probe HRS

Applied voltage: 500 V

Measuring environment: 32±2° C., 80±5% RH

The coating liquid for forming the interlayer contains the metal oxide particles such as the surface treated titanium oxide, binder resin and a dispersion medium.

The interlayer contains the metal oxide particles in a ratio of from 1 to 10,000, and preferably from 50 to 1,000, parts by weight to 100 parts of the binder resin. Under such the condition, the dispersing state of the metal oxide particles can be sufficiently maintained and the satisfactory interlayer can be formed in which the occurrence of the dielectric breakdown and the black spots is inhibited and the potential variation is small.

As the binder for dispersing the particles and forming the interlayer, polyamide resins are preferable for obtaining good dispersing state, the following polyamide resins are particularly preferred.

Polyamide resins each having a heat of fusion of from 0 to 40 J/g and a water absorption degree of not more than 5% are preferable for the binder of the interlayer. The heat of fusion of the resin is preferably from 0 to 30 J/g, and most preferably from 0 to 20 J/g. By such the polyamide resins, the moisture content is suitably kept, and the occurrence of the dielectric breakdown and the black spot, increasing of the remaining potential and the formation of fog are inhibited. Accordingly, the water absorption degree is more preferably not more than 4%.

The heat of fusion of the resin is measured by differential scanning calorimetry DSC. Another method may be utilized as long as a result the same as that obtained by DSC can be obtained. The heat of fusion is obtained from the area of endothermic peak in the course of temperature rising in the DSC measurement.

The water absorption degree of the resin is measured by the weight variation by a water immersion method or Karl-Fischer's method.

As the binder resin of the interlayer, a resin superior in the solubility in solvent is necessary for forming the interlayer having a uniform layer thickness. Alcohol-soluble polyamide resins are preferable for the binder resin of the interlayer. As such the alcohol-soluble polyamide resin, copolymerized polyamide resins having a short carbon chain between the amide bond such as 6-Nylon and methoxymethylized polyamide resins have been known. These resins have high water absorption degree, and the interlayer employing such the polyamide tends to have high dependency on the environmental condition. Consequently, the sensitivity and the charge property are easily varied under high temperature and high humidity or low temperature and low humidity condition, and the dielectric breakdown and the black spots occur easily.

In the invention, the alcohol-soluble polyamide resins having a heat of fusion of from 0 to 40 J/g and a water absorption degree of not more than 5% by weight are employed to improve such the shortcoming of the usual alcohol-soluble polyamide resin. Thus good electrophotographic image can be obtained even when the exterior environmental conditions are changed and the electrophotographic photoreceptor is continuously used for a prolonged period.

The alcohol-soluble polyamide resin having a heat of fusion of from 0 to 40 J/g and a water absorption degree of not more than 5% by weight is described below.

It is preferable that the alcohol-soluble polyamide resins contains structural repeating units each having a number of carbon atoms between the amide bonding of from 7 to 30 in a ratio of from 40 to 100 Mole-% of the entire repeating units.

The repeating unit means an amide bonding unit constituting the polyamide resin. Such the matter is described below referring the an examples of polyamide resin (Type A) in which the repeating unit is formed by condensation of compounds each having both of an amino group and a carboxylic acid group and examples of the polyamide resin (Type B) in which the repeating unit is formed by condensation of a diamino compound and a di-carboxylic acid compound.

The repeating unit structure of Type A is represented by Formula 2, in which the number of carbon atoms included in X is the carbon number of the amide bond unit in the repeating unit. The repeating unit structure of Type B is represented by Formula 3, in which both of the number of carbon atoms included in Y and that included in Z are each the number of carbon atoms of the amide bond in the repeating unit structure.

Formula 2

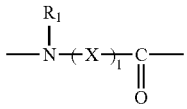

In the above, $R_1$ is a hydrogen atom or a substituted or unsubstituted alkyl group; X is an alkylene group, a group containing di-valent cycloalkane group or a group having mixed structure of the above; the above groups represented by X may have a substituent; and 1 is a natural number.

Formula 3

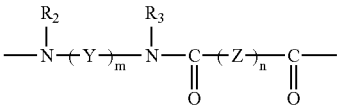

In the above, $R_2$ and $R_3$ are each a hydrogen atom, a substituted or unsubstituted alkyl group; Y and Z are each an alkylene group, a group containing a di-valent cycloalkane group or a group having mixed structure of the above, the above groups represented by Y and Z each may have a substituent; and m and n are each a natural number.

Examples of the structure of repeating unit having carbon atoms of from 7 to 30 are a substituted or unsubstituted alkylene group, an alkylene group, a group containing a di-valent cycloalkane group or a group having mixed structure of the above, and the above groups represented by Y and Z each may have a substituent. Among them the structures having the di-valent cycloalkane groups are preferred.

In the polyamide resin to be used in the invention, the number of the carbon atoms between the amide bonds of the repeating unit structure is from 7 to 30 for inhibiting the hygroscopic property of the polyamide resin so that the photographic properties, particularly the humidity dependency of the potential on the occasion of the repeating use is made small and the occurrence of the image defects such as the black spots is inhibited without lowering of the solubility of the resin in the solvent for coating. The carbon number is preferably from 9 to 25, more preferably from 11 to 20. The ratio of the structural repeating unit having from 7 to 30 between the amide bonds to the entire repeating units is from 40 to 100 mole-percent, preferably from 60 to 100 mole-percent, and further preferably from 80 to 100 mole-percent.

It is preferable that the ratio of the repeating unit having the carbon number between the amide bonds of from 7 to 30 to the entire repeating units is not less than 40 mole-percent.

Polyamide resins having a repeating unit structure represented by Formula 4 are preferred.

Formula 4

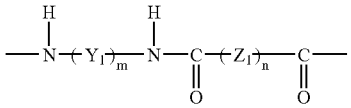

In the above, $Y_1$ is a di-valent group containing an alkyl-substituted cycloalkane group, $Z_1$ is a methylene group, m is an integer of from 1 to 3 and n is an integer of 3 to 20.

The polyamide resins in which the group represented by $Y_1$ is the group represented by the following formula are preferable since such the polyamide resins display considerable improving effect on the black spot occurrence.

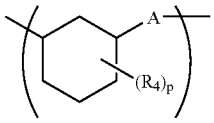

In the above, A is a simple bond or an alkylene group having from 1 to 4 carbon atoms; $R_4$ is an alkyl group; and p is a natural number of from 1 to 5. Plural $R_4$ may be the same as or different from each other.

Concrete examples of the polyamide resin are shown below.

N-1

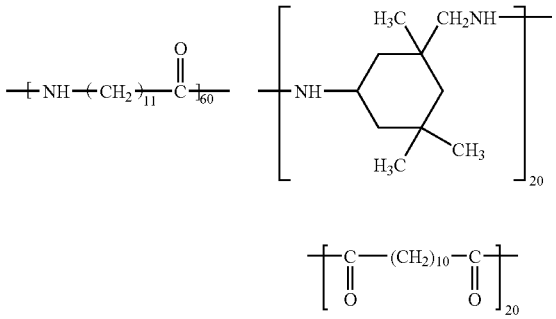

(100%)

-continued
N-2
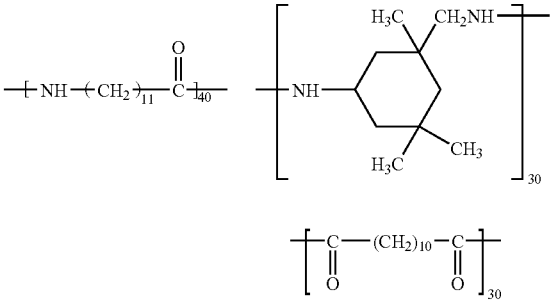
(100%)
N-3
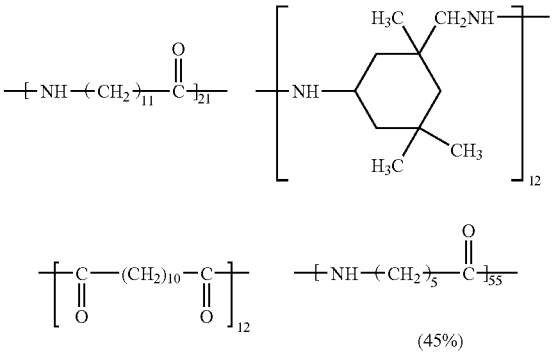
(45%)
N-4
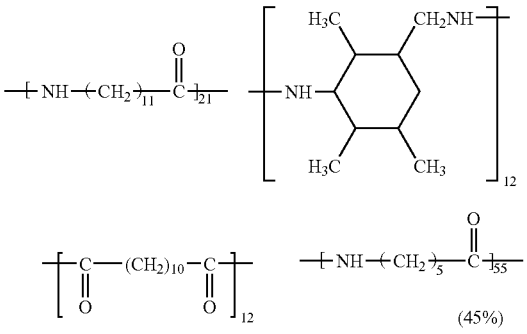
(45%)
N-5
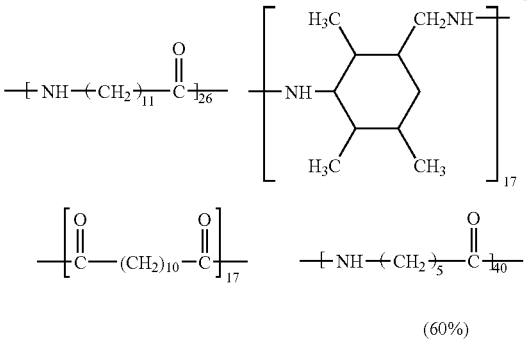
(60%)
-continued
N-6
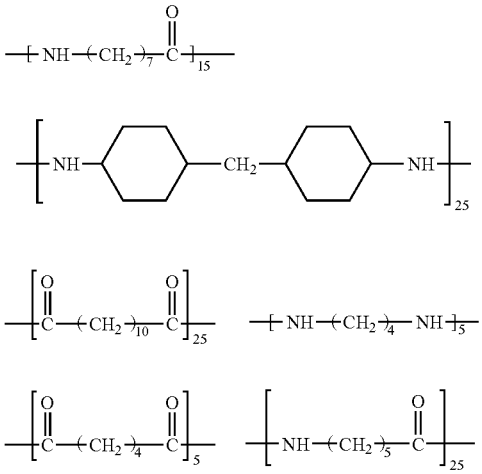
(65%)
N-7
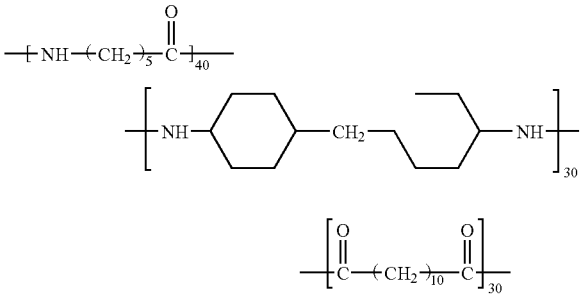
(60%)
N-8
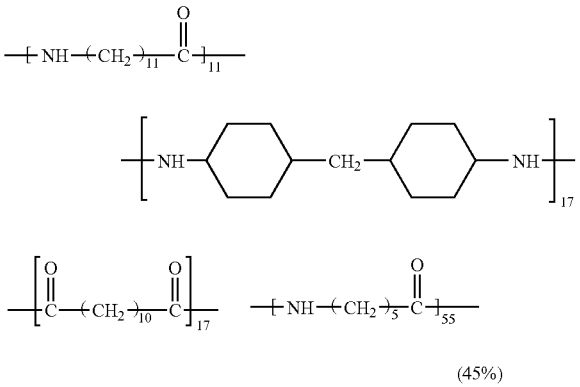
(45%)

-continued

N-9

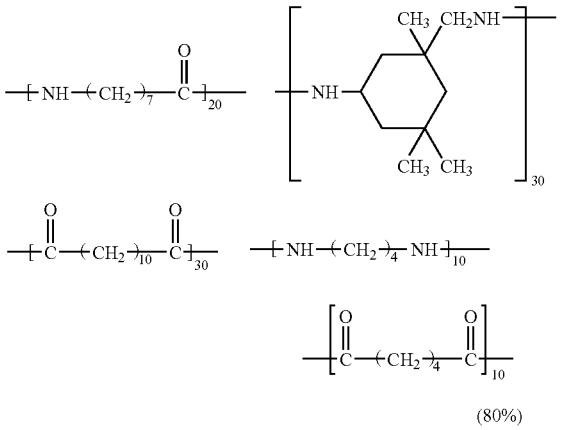

(80%)

N-10

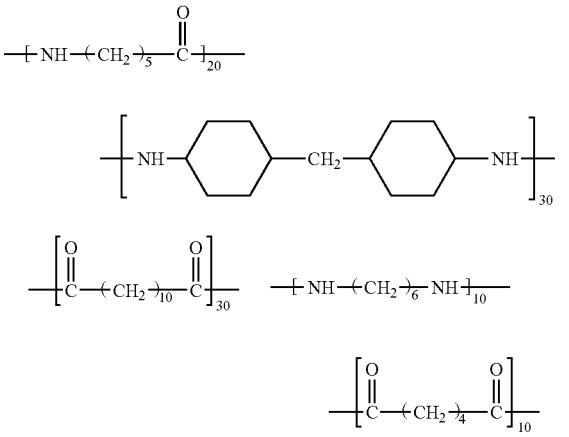

(60%)

N-11

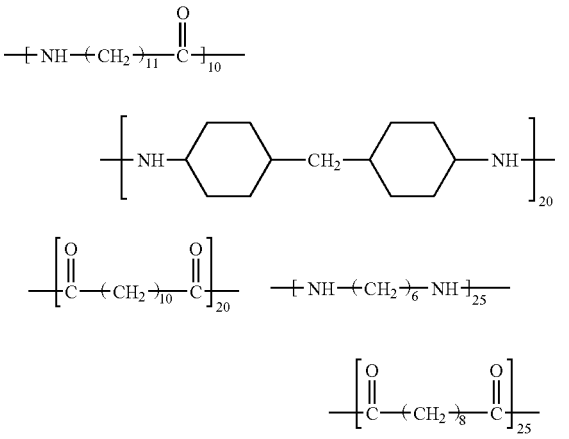

(75%)

In the above concrete examples, percentage shown in the parentheses represents the ratio in terms of mole-% of the repeating units having the 7 or more atoms between the amide bonds.

Among the above examples, the polyamide resins of N-1 through N-4 having the repeating unit represented by Formula 4 are particularly preferred.

The molecular weight of the polyamide resins is preferably from 5,000 to 80,000, more preferably from 10,000 to 60,000, in terms of number average molecular weight, because the uniformity of the thickness of the coated layer is satisfactory and the effects of the invention are sufficiently realized, and the solubility of the resin in the solvent is suitable, formation the coagulates of the resin in the interlayer and the occurrence of the image defects such as the black spots are inhibited.

As the polyamide resin, for example, Bestamelt X1010 and X4685, manufactured by Daicel•Dexa Co., Ltd., available in the market are usable.

Synthesis of Exemplified Polyamide Resin N-1

In a polymerization kettle, to which a stirrer, nitrogen, a nitrogen gas introducing pipe, a thermometer and a dehydration tube were attached, 215 parts by weight of lauryllactam, 112 parts by weight of 3-aminomethyl-3,5,5-trimethylcyclohexylamine, 153 parts by weight of 1,12-dodecane dicarboxylic acid and 2 parts by weight of water were mixed and reacted for 9 hours while applying heat and pressure and removing water by distillation. The resultant polymer was taken out and the composition of the copolymer was determined by $C^{13}$-NMR, the composition of the polymer agreed with that of N-11. The melt flow index (MFI) of the above-synthesized copolymer was 5 g/10 min under the condition of 230° C./2.16 kg.

As the solvent for preparing the coating liquid, alcohols having 2 through 4 carbon atoms such as ethanol, n-propyl alcohol, iso-propyl alcohol, n-butanol, t-butanol and sec-butanol are preferable from the viewpoint of the solubility of the polyamide resin and the coating suitability of the prepared coating liquid. These solvents are employed in a ratio of from 30 to 100%, preferably from 40 to 100%, and further preferably from 50 to 100%, by weight of the entire solvent amount. As solvent aid giving preferable effects when it is used together with the foregoing solvents, methanol, benzyl alcohol, toluene, methylene chloride, cyclohexanone and tetrahydrofuran are preferable.

The charge transfer layer is constituted by suitably selected charge transfer material and binder.

As the charge transfer material, for example, triphenylamine derivatives, hydrazone compounds, benzidine compounds and butadiene compounds can be employed solely or in combination. These charge transfer materials are usually dissolved in a suitable binder for the layer formation.

Resins employable in the charge transfer layer (CTL) are, for example, polystyrene, acryl resins, methacryl resins, vinyl chloride resins, vinyl acetate resins, poly(vinyl butyral) resins, epoxy resins, polyurethane resins, phenol resins, polyester resins, alkyd resins, polycarbonate resins, silicone resins, melamine resins and copolymers containing two or more structural repeating units of the foregoing resins. Other than the above insulating resin, organic semi-conductive polymers such as poly-N-vinylcarbazole are usable.

The polycarbonate resins are most preferable as the binder of the CTL since the polycarbonate resins show suitable dispersing ability to the CTM and improve the electrophotographic properties. The ratio of the charge transfer material to the binder resin is preferably from 10 to 200 parts by weight to 100 parts by weight of the binder resin.

It is preferable to add an anti-oxidation agent to the charge transfer layer. Typical anti-oxidation agent is substances which prevent or inhibit the action of oxygen to auto-oxidizable substance being in or on the electrophotographic photoreceptor under conditions with light, heat or electric discharge.

The electrophotographic photoreceptor having the charge transfer layer, particularly the layer constitution of the organic photoreceptor is described below.

The organic photoreceptor is an electrophotographic photoreceptor which contains an organic compound showing at least one of the charge generation function and the charge transfer function essential for the electrophotographic photoreceptor. There are a photoreceptor constituted by the organic charge generation material or the charge transfer material, and a photoreceptor constituted by a polymer complex having the charge generation function and the charge transfer function.

The organic photoreceptor to be employed in the invention is described below.

Electroconductive Substrate

Both of sheet-shaped and cylinder-shaped electroconductive substrates may be employed, and the cylindrical one is preferred for making the image forming apparatus to compact.

The cylindrical electroconductive substrate is a cylindrical support by which images can be endlessly formed by the rotation of the substrate. An electroconductive substrate having a straightness of not more than 0.1 mm and a swinging of not more than 0.1 mm is preferred.

As the electroconductive material, a metal drum made from a metal such as aluminum and nickel, a plastic drum evaporated with aluminum, tin oxide or indium oxide, or a paper of plastic drum having an electroconductive substance on the surface thereof. The electroconductive supports preferably have a specific resistivity of not more than $10^3$ Ω·cm.

The electroconductive substrate may have a sealing-treated anodized layer on the surface thereof.

Interlayer

The interlayer having the barrier function is provided between the electroconductive substrate and the light sensitive layer. The interlayer is preferably an insulation layer.

Light Sensitive Layer

The light sensitive layer is preferably a layer in which the function of the light sensitive layer is partially charged to the charge generation layer (CGL) and the charge transfer layer (CTL), even though the layer may be a single layer provided on the interlayer, which has both of the charge generation function and the charge transfer function. By the function separated structure, the increasing of the remaining potential accompanied with the repeating use can be reduced and the electrophotographic properties can be easily controlled for fitting the purpose. In the photoreceptor to be negatively charged, it is preferred that the charge generation layer CGL is provided on the interlayer and the charge transfer layer CTL is provided on the charge generation layer. In the photoreceptor to be positively charged, CTL and CGL are provided in this order on the interlayer. In the invention, the function separated type negatively charging photoreceptor is most preferred, in which CGL and CTL are provided on the interlayer in this order.

Each of the layers is described below.

Charge Generation Layer

The charge generation layer contains the charge generation material CGM. The layer may be further contains a binder resin and another additive.

As the charge generation material CGM, for example, phthalocyanine pigments, azo pigments, perylene pigments and azulenium pigments are usable. Among them, the CGM capable of minimizing the remaining potential accompanied with the repeating use is ones each having a crystal structure which can take a stable coagulation structure between plural molecules thereof. In concrete, phthalocyanine pigments and perylene pigments each having a specific crystal structure are cited as the CGM. For example, the CGM such as titanylphthalocyanine having the highest diffraction peak at 27.2° of Bragg angle 2θ of Cu—Kα ray, titanylphthalocyanine having a considerable diffraction peak at Bragg angle 2θ of 28.7°, and benzimidazoleperylene having the highest diffraction peak at Bragg angle 2θ of 12.4° show almost not degradation accompanied with the repeating use and the increasing the remaining potential is small.

A binder can be employed in the charge generation layer as the dispersing medium of the CGM. The most preferable resin usable as the binder are formal resins, butyral resins, silicone resins, silicone-modified butyral resins, and phenoxy resins. The remaining potential accompanied with repeating use can be made minimum, sufficient sensitivity can be obtained, the remaining potential can be stabilized and the occurrence of the dielectric breakdown and the black spots can be inhibited by the use of such the resins. The ratio of the charge generation material to the binder is preferably from 20 to 600 parts by weight to 100 parts by weight of the binder resin. The thickness of the charge generation layer is preferably from 0.01 μm to 1 μm.

Charge Transfer Layer

The thickness of the charge transfer layer is preferably from 5 to 20 μm for inhibiting the occurrence of the dielectric breakdown and the black spots and reducing the spreading image and the degradation of sharpness.

The most preferable layer constitution of the photosensitive layer is exemplified in the above-mentioned, even though another constitution may also be utilized.

The followings are usable as the solvent or the dispersing medium for formation of the interlayer, the charge generation layer and the charge transfer layer: n-butylamine, diethylamine, ethylenediamine, iso-propanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichioropropane, 1,1,2-trichloroethane, 1,1,1-trichloroethane, trichloroethylene, tetrachloroethane, tetrahydrofuran, dioxolane, dioxane, methanol, ethanol, butanol, iso-propanol, ethylacetate, butyl acetate, dimethylsulfoxide and methyl cellosolve. Dichloromethane 1,2-dichloroethane and methyl ethyl ketone are preferably employed. These solvents may be employed singly or in a state of mixed solvent of two or more kinds thereof.

The coating liquids for each layer are preferably filtered through a metal filter or a membrane filter to eliminate a foreign matter or a coagulated matter. A suitable filter is selected from a pleats type filter HDC, depth type filter (Profile) and semi-depth type filter (Profilestar), each manufactured by Paul Co., Ltd., according to the properties of the coating liquid.

For coating the layer, coating methods such as an immersion coating, spray coating and circular amount regulation type coating are utilized. For the protective layer, the circular amount regulation type coating method is most preferable. Japanese Patent Publication Open to Public Inspection No. 58-189061 describes about circular amount regulation type coating.

The image forming apparatus employing the contact charging system relating to the invention is described below.

FIG. 1 shows a schematic cross section of image forming apparatus 1 employing the contact charging system relating to the invention. In the image forming apparatusn 1, a photoreceptor cartridge 2, a developing cartridge 3, an exposure device 4 which emits laser beam modulated by image signals from exterior while swinging the direction, a paper supplying device 5 for supplying a recording paper sheet, a transfer roller 6, a fixing device 7 and a paper output tray 8 are arranged.

Figure 2:
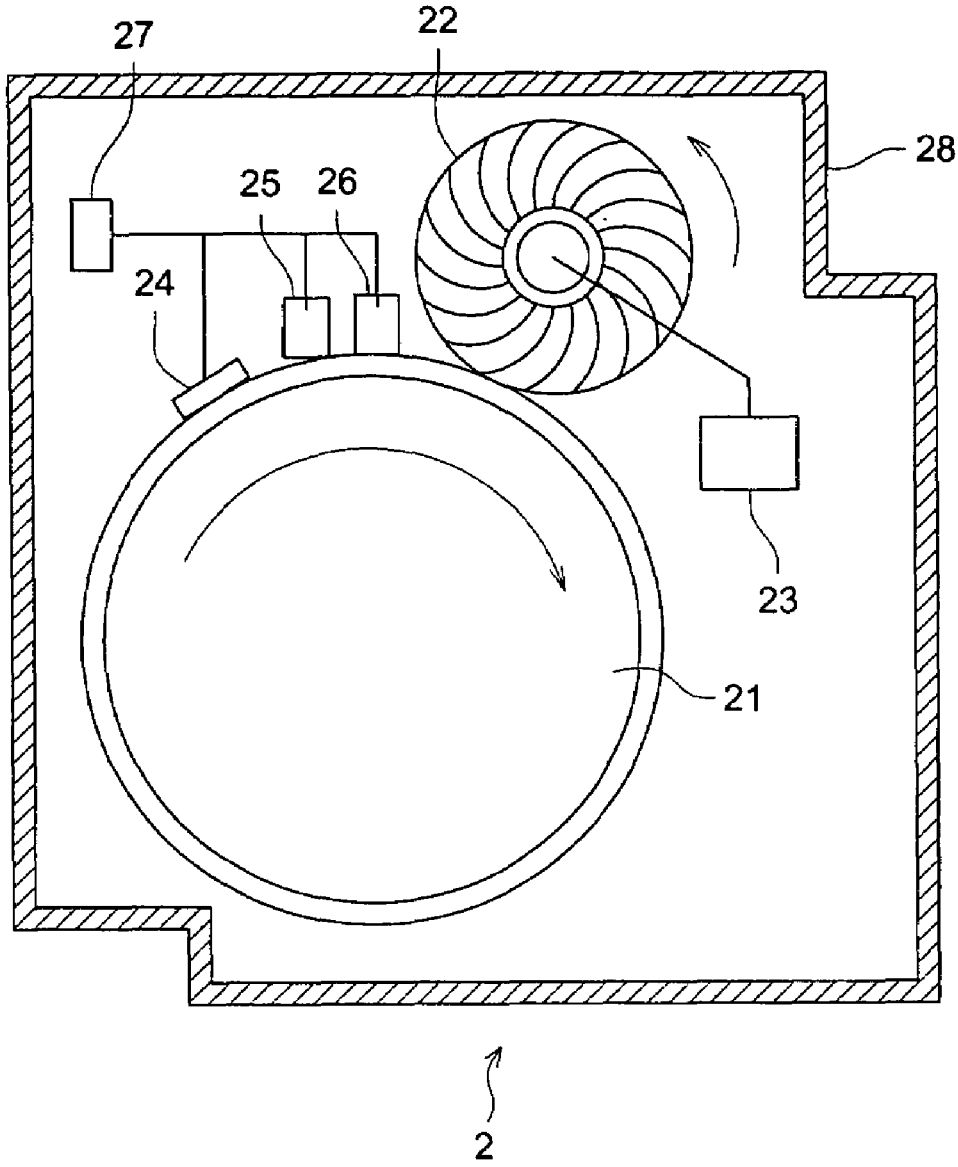
FIG. 2 is a schematic cross section of the photoreceptor cartridge 2 capable of being freely installed to or released from the image forming apparatus 1.

The photoreceptor cartridge 2 is shown in FIG. 2, in which a photoreceptor 21 composed of a thin layer of an organic photoconductive material provided on the circumference of the cylinder, and a charging brush 22 are provided. The developing device 3 has therein a developing sleeve, a stirring roller, and a toner tank containing a toner and a carrier, which are not shown in the drawing, and developing bias is applied to the developing sleeve from a developing power source not shown in the drawing. On each of the cartridges, a protective cover not shown in the drawing is provided which is closed when the cartridge is inserted into the image forming apparatus 1 and is opened when the cartridge is taken out from the apparatus 1 so as to avoid the inconvenient caused by the mechanical touching on the occasion of the installing/releasing the cartridge.

The image forming process is briefly described below. The surface of the photoreceptor 21 is uniformly charged at a designated voltage by the charging brush 22. By the exposure device 4, the modulated laser beam, shown by the arrow by broken line, is generated and reflected by the polygon mirror not shown in the drawing so as to scan the photoreceptor 21 and to successively form an electrostatic latent image according to the image information on the charged surface of the photoreceptor. The toner contained in the toner tank is stirred by the stirring roller and then supplied on the developing sleeve so as to form a toner image corresponding to the electrostatic latent image at the facing portion to the photoreceptor 21. On this occasion, the remained toner being at the area not exposed to light or the non image area is recovered in the developing cartridge by the electrostatic force caused by the potential difference between the bias voltage applied to the developing sleeve and the surface potential of the photoreceptor. On the other hand, the toner image is electro-statically transferred onto the recording paper by the transfer roller 6 which is arranged so as to be faced to the photoreceptor 21. The recording paper is conveyed along the conveying pass shown by the solid line arrow sign from the paper supplying device 5. And then the recording paper is conveyed into the fixing device 7 where the toner image is fixed by heating onto the recording paper. After that, the recording paper on which the designated image is formed, is output on the output tray 8. A lot of copies of the original image can be prepared by repeating the above series of the processing.

The charging brush mechanically stirs the toner remained on the photoreceptor surface and conveyed by the rotation of the photoreceptor to the portion where the charging brush and the photoreceptor are touched so that the remained toner image is diffused and made illegible. The charging brush absorbs to recover the toner having the charge with reversal polarity to that of the photoreceptor and gives the charge with the same polarity as that of the photoreceptor. Thereafter, the toner is supplied to the photoreceptor.

FIG. 2 shows a schematic drawing of the cross section of the photoreceptor cartridge 2 which can be freely installed to and released from the image forming apparatus 1. The photoreceptor cartridge 2 is included in a casing 28 with a protective cover and comprises the photoreceptor 21 as the image carrier, and the charging brush 22, a power source connecting member 23 for supplying the designated voltage to the charging brush, a pre-charging film 24, charge unifying members (sponge like charging members) 25 and 26, and a power source connecting member 27 are arranged around the photoreceptor 21.

The photoreceptor is rotated by a diving means, not shown in the drawing, in the direction of the arrow sign in the drawing. The charging brush 22 is constituted by electroconductive threads composed of fur-like fibers implanted to a brush support. The charging brush is rotated by a driving means, not shown in the drawing, while touching with the photoreceptor in the direction of the arrow sign in the drawing, namely in the same direction as that of the photoreceptor at the portion where the charging brush is touched to the photoreceptor. A voltage is applied to the charging brush 22 from a charging power source, not shown in the drawing, on the occasion of the image formation, by which the surface of the photoreceptor 21 is uniformly charged with the designated polarity. On the other hand, on the occasion of no image formation, a voltage with reverse polarity to that at the image formation is applied to the charging brush 22. The polarity of the charging of the toner is the same as that of the charging voltage at the image formation. Consequently, the toner accumulated in the charging brush 22 can be exhausted onto the photoreceptor 21 by the electrostatic repulsion force.

The developing pre-charging film 24 and the charge unifying members 25 and 26 are provided to compensate the unevenness of charge by the charging brush 22.

Though the forgoing image forming apparatus is a monochromatic laser printer, the image forming system can be also applied to a color printer or a color copier.

Though the forgoing image forming apparatus is an example of cleanerless image forming apparatus, the apparatus may be an image forming apparatus having a cleaning means exclusive for recovering the remaining toner. Namely, the invention can be applied to an image forming apparatus other than the cleanerless type.

EXAMPLES

The invention is described in detail below referring examples. In the followings, "parts" represent "parts by weight".

Photoreceptors were prepared as follows.

Preparation of Photoreceptor 1

Interlayer 1

The following interlayer coating liquid was coated by an immersion method to form the interlayer 1 having a dry thickness of 10 μm on a washed aluminum substrate subjected to shaving treatment so as to make the surface roughness Rz of 1.0 μm.

The following dispersion for interlayer was diluted two times by the solvent the same as that used in the dispersion, and, after standing for one night, filtered by Ridgimesh Filter having a nominal filtration accuracy of 5 μm, manufactured by Nihon Paul Co., Ltd., under a pressure of 50 kPa to prepare an interlayer coating liquid.

Preparation of Dispersion for Interlayer

| | |
|---|---|
| Binder resin (Exemplified polyamide N-1) | 1 part |
| Anatase type titanium oxide A1 containing 0.5% by weight of niobium element (primary particle diameter: 5 nm, surface treated by ethyltrimethoxysilane fluoride) | 3.0 parts |
| Iso-propyl alcohol | 10 parts |

The above components were mixed and dispersed by a sand mill dispersing machine for 10 hours by a butch system to prepare an interlayer coating liquid.

Charge Generation Layer

The following components were mixed and dispersed by the sand mill to prepare a charge generation layer coating liquid. The coating liquid was coated on the interlayer by the immersion method to form a charge generation layer having a dry thickness of 0.3 μm.

B type oxytitanylphthalocyanine (a titanylphthalocyanine pigment showing considerable diffraction peak at Bragg angle (2θ±0.2°) of 7.5° and 28.7° in the X-ray

| | |
|---|---|
| diffraction spectrum of the Cu-Kα characteristic X-ray) | 20 parts |
| Poly(vinyl butyral) BX-1 (Sekisui Kagaku Co., Ltd.) | 10 parts |
| Methyl ethyl ketone | 700 parts |
| Cyclohexanone | 300 parts |

Charge Transfer Layer

The following components were dissolved to prepare a charge transfer layer coating liquid. The coating liquid was coated on the charge generation layer by the immersion method to form a charge transfer layer having a dry thickness of 15 μm. Thus photoreceptor 1 was prepared.

| | |
|---|---|
| Charge transfer material (4-methoxy-4'-(4-methyl-α-phenylstyryl) triphenylamine | 70 parts |
| Polycarbonate resin Iupiron-Z300 (Mitsubishi Gas Kagaku Co., Ltd.) | 100 parts |
| Anti-oxidizing agent (the following compound A) | 2 parts |
| Tetrahydrofuran/toluene (8/2 in volume ratio) | 750 parts |

Preparation of Photoreceptor 2 Through 18

Photoreceptor 2 through 18 were prepared in the same manner as in Photoreceptor 1 except that the surface roughness of the aluminum substrate, the particle, the binder resin and the dry thickness of the interlayer, and the charge transfer material and the thickness of the charge transfer layer were changed as listed in Table 1.

On the other hand, each of the interlayer coating liquid was coated on an aluminum evaporated poly(ethylene terephthalate) substrate was coated and dried under the condition the same as that in the forgoing photoreceptor to form an interlayer having a thickness of 10 μm as the sample for measuring the volume resistivity. As the results of the measurements, the volume resistivity of the interlayer of each of Photoreceptors 1 through 18 were entirely not less than $1\times10^8$ Ω·cm.

TABLE 1-1

Compound A

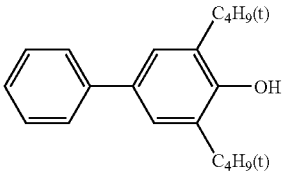

| | | Interlayer | | | | | | | | | | |
|---|---|---|---|---|---|---|---|---|---|---|---|---|
| | | Kind and Surface treatment of metal oxide | | | Binder resin | | | | | | | |
| Photo-receptor | Surface roughness (Rz:μm) | kind of particle | Diameter of primary primary (nm) | Surface treatment | Kind | Heat to fusion (J/g) | Water absorbing degree | Ratio of structural unit having 7 or more carbon atoms (mole-%) | solvent | Layer thickness (μm) | Charge transfer layer Layer thickness (μm) |
| 1 | 1.0 | A1 | 35 | *1 | N-1 | 0 | 1.9 | 100 | Iso-propyl alcohol | 10 | 15 |
| 2 | 1.0 | A1 | 35 | *1 | N-2 | 0 | 2.0 | 100 | Iso-propyl alcohol | 12 | 18 |
| 3 | 1.0 | A1 | 35 | *1 | N-3 | 0 | 2.8 | 45 | Iso-propyl alcohol | 18 | 15 |
| 4 | 1.0 | A1 | 35 | *1 | N-6 | 12 | 3.4 | 65 | Iso-propyl alcohol/butanol (6/1) | 10 | 8 |
| 5 | 1.0 | A1 | 35 | *1 | N-7 | 28 | 3.8 | 60 | Iso-propyl alcohol/butanol (6/1) | 15 | 10 |
| 6 | 1.0 | A1 | 35 | *1 | N-8 | 23 | 4.5 | 45 | Ethanol/1-propanol (1/5) | 7 | 15 |
| 7 | 0.5 | A2 | 180 | Octyltrimethoxysilane | N-1 | 0 | 1.9 | 100 | Iso-propyl alcohol | 15 | 5 |
| 8 | 1.0 | A2 | 65 | Fluorinated ethyltrimethoxysilane | N-1 | 0 | 1.9 | 100 | Iso-propyl alcohol | 5 | 15 |
| 9 | 2.5 | A4 | 15 | *1 | N-1 | 0 | 1.9 | 100 | Iso-propyl alcohol | 25 | 15 |

TABLE 1-1-continued

Compound A

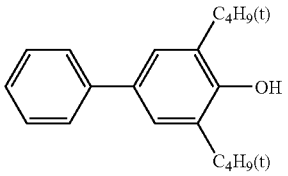

| | | Interlayer | | | | | | | | | |
|---|---|---|---|---|---|---|---|---|---|---|---|
| | | Kind and Surface treatment of metal oxide | | | Binder resin | | | | | | |
| Photo-receptor | Surface roughness (Rz:μm) | kind of particle | Diameter of primary primary (nm) | Surface treatment | Kind | Heat to fusion (J/g) | Water absorbing degree | Ratio of structural unit having 7 or more carbon atoms (mole-%) | solvent | Layer thickness (μm) | Charge transfer layer Layer thickness (μm) |
| 10 | 1.0 | Z | 100 | methyltrime thoxysilane | N-1 | 0 | 1.9 | 100 | Iso-propyl alcohol | 15 | 15 |

TABLE 1-2

| | | Interlayer | | | | | | | | | |
|---|---|---|---|---|---|---|---|---|---|---|---|
| | | Kind and Surface treatment of metal oxide | | | Binder resin | | | | | | |
| Photo-receptor | Surface roughness (Rz: μm) | Kind of particle | Diameter of primary particle (nm) | Surface treatment | Kind | Heat of fusion (J/g) | Water absorbing degree | Ratio of structural unit having 7 or more carbon atoms (mole-%) | Solvent | Layer thickness (μm) | Charge transfer layer Layer thickness (μm) |
| 11 | 1.0 | AL | 40 | methyl-trimethoxy-silane | N-1 | 0 | 1.9 | 100 | Iso-propyl alcohol | 15 | 15 |
| 12 | 1.0 | Zr | 120 | *1 | N-1 | 0 | 1.9 | 100 | Iso-propyl alcohol | 15 | 15 |
| 13 | 1.0 | A1 | 35 | *1 | N-12 | 24 | 8.5 | 0 | Methanol | 15 | 20 |
| 14 | 1.0 | A5 | 150 | *1 | N-1 | 0 | 1.9 | 100 | Iso-propyl alcohol | 15 | 15 |
| 15 | 1.0 | A6 | 40 | *1 | N-8 | 23 | 4.5 | 45 | Iso-propyl alcohol/ butanol (6/1) | 8 | 15 |
| 16 | 1.0 | A1 | 35 | *1 | N-1 | 0 | 1.9 | 100 | Iso-propyl alcohol | 4 | 17 |
| 17 | 1.0 | A1 | 35 | *1 | N-1 | 0 | 1.9 | 100 | Iso-propyl alcohol | 27 | 17 |
| 18 | 1.0 | A1 | 35 | *1 | N-1 | 0 | 1.9 | 100 | Iso-propyl alcohol | 15 | 4 |
| 19 | 1.0 | A1 | 35 | *1 | N-1 | 0 | 1.9 | 100 | Iso-propyl alcohol | 15 | 22 |

*1 Methylhydrogenpolysiloxane

In the table:

A1: Anatase type titanium oxide containing 0.5% by weight of niobium element (anatase ratio: 100%)

A2: Anatase type titanium oxide containing 1.0% by weight of niobium element (anatase ratio: 95%)

A3: Anatase type titanium oxide containing 300 ppm of niobium element (anatase ratio: 100%)

A4: Anatase type titanium oxide containing 1.8% by weight of niobium element (anatase ratio: 92%)

A5: Anatase type titanium oxide containing no niobium element (anatase ratio: 94%; niobium content was not more than 10 ppm.)

A6: Rutile type titanium oxide containing 0.5% of niobium element

AL: Alumina ($Al_2O_3$)

Zr: Zirconium oxide ($ZrO_2$)

In the table, "surface treatment" represents the substance employed for the surface treatment.

The heat of fusion and the water absorbing degree were measured as follows:

Measurement of Heat of Fusion

Measuring apparatus: Shimadzu Flow Rate Differential Scanning Calorimeter DSC-50 manufactured by Shimadzu Seisakusho Co., Ltd.

Measuring condition: The sample to be measured was set in the measuring apparatus and measurement was stated at a room temperature (24° C.). The temperature was raised by 200° C. in a rate of 5° C. per minute and then cooled by the room temperature in a rate of 5° C. per minute. Such the operation was repeated two times and the heat of fusion was calculated from the area of the endothermic peak caused by the fusion in the course the secondary temperature rising.

Measuring Condition of Water Absorption Degree

The sample to be measured was satisfactorily dried at a temperature of from 70 to 80° C. spending 3 to 4 hours and the sample was precisely weighed. After that the sample was put into deionized water kept at 20° C. and taken out after a designated period and water adhered at the surface of the sample was wiped off by a clean cloth, and then the sample was weighed. Such the operation was repeated until the increasing of the weight was saturated. Thus measured increased weight of the sample was divided by the initial weight. The quotient was defined as the water absorption degree.

In the table, "Ratio of structural unit having 7 or more carbon atoms" is the ratio in mole-% of the structural unit having 7 or more carbon atoms between the amide bonds in the structural unit. N-12 is methoxymethylized Nylon 6 in which the carbon number between the amide bonds is 5 and methoxymethylized degree is 25%.

Evaluation

The above-prepared Photoreceptors 1 through 18 were each installed in a printer EPSON LP-2400, (sold by Epson Co., Ltd., printing rate: 16 sheets of A4 size paper per minute) which principally has the structure shown in FIGS. 1 and 2, and the evaluation was performed under the conditions of high temperature and high humidity at 30° C. and 80% RH, and low temperature and low humidity at 10° C. and 20% RH. The evaluation items were changed according to the above evaluation conditions. Results of the evaluation are shown in Table 2.

Exposure Condition

Objective potential of exposed area: Exposure amount was set so that the potential of the exposure area is less than −50 V.

Exposure light beam: Imagewise exposure with a dot density of 600 dpi (dpi is the number of dot per 2.54 cm) was performed. A semi-conductor laser emitting light of 780 nm was employed.

Developing condition: Reversal development employing a non-magnetic single-component developer Evaluation Items and Methods Evaluation Items and Evaluation Norms Evaluation of Remaining Potential (Variation of the Potential at the Solid Black Image Area)

Under conditions of low temperature and low humidity (LL: 10° C. and 20% RH), and high temperature and high humidity (HH: 30° C. and 80% RH), a A4 size original image was copied for 10,000 sheets in a sheet intermittent mode, which was equally quartered each having a character image with a pixel ratio of 7%, a halftone image, a white solid image and a black solid image, respectively. The variation of the potential of the black image area |ΔV| was determined by the potential at the initial time and that after printing of 10,000 sheets of copy at the development portion. A smaller value of |ΔV| was corresponding to smaller increasing of the remaining potential.

A: The potential variation |ΔV| at the black solid image area was less than 50 V; Fine.

B: The potential variation |ΔV| at the black solid image area was from 50 V to 150 V; no problem was caused in the practical use.

C: The potential variation |ΔV| at the black solid image area was larger than 150 V; problems were caused in the practical use.

Evaluation of Charge Potential (Variation of Potential at the Solid White Image Area)

Under conditions of low temperature and low humidity (LL: 10° C. and 20% RH), and high temperature and high humidity (HH: 30° C. and 80% RH), a A4 size original image was copied for 10,000 sheets in a sheet intermittent mode, which was equally quartered each having a character image with a pixel ratio of 7%, a halftone image, a white solid image and a black solid image, respectively. The variation of the potential of the white solid image area |ΔV| was determined by the potential at the initial time and that after 10,000 sheets printing at the development portion. A smaller value of |ΔV| was corresponding to smaller potential variation caused by the repeating of the charging.

A: The potential variation |ΔV| at the white solid image area was less than 50 V; Fine.

B: The potential variation |ΔV| at the white solid image area was from 50 V to 150 V; no problem was caused in the practical use.

C: The potential variation |ΔV| at the white solid image area was larger than 150 V; problems were caused in the practical use.

Image Density

The copies taken under the conditions of low temperature and low humidity (LL: 10° C. and 20% RH), and high temperature and high humidity (HH: 30° C. and 80% RH) were subjected to the evaluation.

The relative reflective density when the reflective density of the paper was set at 0 of the copied image was measured by RD-918 manufactured by Macbeth Co., Ltd. When the remaining potential is increased by a lot of time of copying, the density was lowered. The measurement was carried out at the black image area of the $10,000^{th}$ copy.

A: The densities of both the solid black images each formed under the LL and HH conditions were 1.2 or more; fine.

B: The densities of both the solid black images each formed under the LL and HH conditions were from 1.0 to 1.2; no problem was caused in the practical use.

C: At least on of the densities of the solid black images each formed under the LL and HH conditions was less than 1.0; problems were caused in the practical use.

Fog

The copies taken under the conditions of low temperature and low humidity (LL: 10° C. and 20% RH), and high temperature and high humidity (HH: 30° C. and 80% RH) were subjected to the evaluation.

The density of fog was measured as the reflex density of the white solid image by RD-918, manufactured by Macbeth Co., Ltd. The reflex density was defined as a relative density to the density of the A4 size paper without printed image which was set at 0.00. The measurement was performed with respect to the white solid image portion of the 10,000$^{th}$ copy.

A: The densities of both the solid black images each formed under the LL and HH conditions were not more than 0.010; fine.

B: The densities of both the solid black images each formed under the LL and HH conditions were from 0.010 to 0.020; this level of the fogging did not cause any problem in the practical use.

C: At least on of the densities of the solid black images each formed under the LL and HH conditions was more than 0.020; this level of fogging caused problems in the practical use.

C: The frequency of image defects having a size of not less than 0.4 mm: one or more sheets having the defects of not less than 11/A4 were found; problems were caused in the practical use.

Sharpness

The sharpness of the image was evaluated according to the readability of 3-point and 5-point characters printed under the low temperature and low humidity (10° C. and 20% RH) and the high temperature and high humidity (30° C. and 80% RH). The norm of the evaluation was as follows.

A: The image was not spread, and both of the 3-point and 5-point characters were clear and easily readable.

B: The spreading of the image was slight, and a part of 3-point characters was illegible and the 5-point characters were clear and easily readable.

C: The image was spread, and almost 3-point characters and a part of or entire 5-point characters were illegible.

TABLE 2

| Photo-receptor No. | Remaining potential LL | Remaining potential HH | Charging potential LL | Charging potential HH | Evaluation of image: Image density | Fog | Dielectric breakdown | Black spot | Sharpness | Remarks |
|---|---|---|---|---|---|---|---|---|---|---|
| 1 | A | A | A | A | A | A | A | A | A | Inv. |
| 2 | A | A | A | A | A | A | A | A | A | Inv. |
| 3 | A | A | A | A | A | A | A | A | A | Inv. |
| 4 | A | A | A | A | A | A | A | A | A | Inv. |
| 5 | A | A | A | A | A | A | A | A | A | Inv. |
| 6 | A | B | A | A | A | A | A | A | A | Inv. |
| 7 | A | A | B | B | B | B | A | B | B | Inv. |
| 8 | A | A | A | A | A | B | A | B | B | Inv. |
| 9 | B | B | A | A | B | B | A | A | B | Inv. |
| 10 | B | A | A | A | B | A | A | A | A | Inv. |
| 11 | B | B | A | A | A | B | A | A | A | Inv. |
| 12 | A | B | B | A | A | B | A | A | A | Inv. |
| 13 | A | A | A | B | A | B | A | B | B | Inv. |
| 14 | B | B | A | A | B | A | A | B | B | Inv. |
| 15 | B | B | B | B | B | B | A | A | A | Inv. |
| 15 | B | B | B | B | B | B | B | C | C | Comp. |
| 16 | C | C | B | B | C | B | A | B | C | Comp. |
| 17 | B | B | B | B | B | B | B | CX | C | Comp. |
| 18 | B | B | B | B | B | B | A | B | C | Comp. |

Inv.: Inventive
Comp.: Comparative

Dielectric Breakdown

The evaluation was performed under the conditions of low temperature and low humidity (LL: 10° C. and 20% RH), and high temperature and high humidity (HH: 30° C. and 80% RH).

A: The dielectric breakdown on the photoreceptor caused by charge leak did not occur under the LL and HH conditions.

B: The dielectric breakdown on the photoreceptor caused by charge leak occurred under the LL or HH condition.

Periodical Image Defect

The evaluation was performed based on the number per an A4 size print of visible black spot and black-line shaped image defect periodically formed in the same cycle as the rotation of the photoreceptor.

A: The frequency of image defects having a size of not less than 0.4 mm: not more than 5/A4 in entire prints; fine.

B: The frequency of image defects having a size of not less than 0.4 mm: one or more sheets having the defects of from 6/A4 to 10 6/A4 were found; no problem was caused in the practical use.

It is understood from Table 2 that the electrophotographic photoreceptors 1 through 14 according to the invention having the interlayer with a thickness of from 5 to 25 μm and the charge transfer layer with a thickness of from 5 to 20 μm are superior in the stability of the remaining potential and the charging potential. Consequently, the image density is sufficient and the fog density low is low. Furthermore no dielectric breakdown occurs and the occurrence of black spot is considerably inhibited so that an electrophotographic image with high sharpness can be obtained. Particularly, Photoreceptors 1 through 6 each marks. high score in each of the evaluation items, in each of which the interlayer contains the anatase type titanium oxide containing niobium element as the metal oxide particle and the polyamide resin having a heat of fusion of from 0 to 40 J/g and a water absorption ratio of not more than 5% by weight and has a layer thickness of from 7 to 18 μm, and the charge transfer layer has a thickness of from 8 to 18 μm. In contrast, the dielectric breakdown and many black spots occur and the sharpness is low in Photoreceptor 15 having the interlayer of 4 μm. In Photoreceptor 16 having the interlayer of 27 μm, the increase of the remaining potential is large and the image density is low so that the sharpness of the image also lowered. In Photoreceptor 17 having the interlayer of 4 μm, the dielectric breakdown and many black spots occur and the sharpness is low. In Photoreceptor 18 having the interlayer of 22 μm, the dot images are unclear and the sharpness is low.

The increasing of the remaining potential and the variation of the charging potential under the high temperature and high humidity condition and the low temperature and low humidity condition which easily occur in the contact charging system, and the occurrence of the dielectric breakdown can be prevented, and the electrophotographic image superior in the image density, fog and sharpness can be provided by the use of the electrophotographic photoreceptor, processing cartridge, image forming apparatus and the image forming method according to the invention.

The invention claimed is:

1. A method of forming a toner image, comprising steps of:

electrically charging an electrophotographic photoreceptor by contacting a charging device to the photoreceptor;

imagewise exposing the photoreceptor so that a latent image is formed on the photoreceptor; and developing the latent image with toner so that a toner image is formed on the photoreceptor;

wherein the photoreceptor comprises an interlayer with a thickness of from 5 to 25 μm, the interlayer containing anatase titanium oxide particles which contain niobium element in an amount of from 100 ppm to 2.0% by weight, and a charge generation layer and a charge transfer layer with a thickness of from 5 to 20 μm each provided on an electroconductive substrate.

2. The method of forming a toner image of claim 1, wherein a number average diameter of primary particles of the anatase titanium oxide particles is from 4 to 400 nm.

3. The method of forming a toner image of claim 1, wherein the interlayer contains polyamide resin having a heat of fusion of from 0 to 40 J/g and a water absorption degree of not more than 5% by weight.

4. The method of forming a toner image of claim 3, wherein the polyamide resin has the heat of fusion from 0 to 20 J/g and a water absorption degree of not more than 4% by weight.

5. The method of forming a toner image of claim 1, wherein the interlayer has a volume electric resistivity of not less than $10^8$ Ω·cm.

6. The method of forming a toner image of claim 5, wherein a thickness of the interlayer is from 7 to 15 μm.

7. The method of forming a toner image of claim 1, wherein a thickness of the interlayer is from 7 to 15 μm.

8. The method of forming a toner image of claim 1, wherein the anatase titanium oxide particles contain the niobium element in an amount of from 300 ppm to 1.8% by weight.

9. The method of forming a toner image of claim 8, wherein a thickness of the interlayer is from 7 to 15 μm.

10. A method of forming a toner image, comprising steps of:

electrically charging an electrophotographic photoreceptor by contacting a charging device to the photoreceptor;

imagewise exposing the photoreceptor so that a latent image is formed on the photoreceptor; and developing the latent image with toner so that a toner image is formed on the photoreceptor;

wherein the photoreceptor comprises an interlayer with a thickness of from 7 to 15 μm, the interlayer containing polyamide resin having a heat of fusion from 0 to 40 J/g and a water absorption degree of not more than 5% by weight, and the interlayer having a volume electric resistivity of not less than $10^8$ Ω·cm, a charge generation layer, and a charge transfer layer with a thickness of from 5 to 20 μm, each provided on an electroconductive substrate.

11. The method of forming a toner image of claim 10, wherein the interlayer contains $TiO_2$, $ZrO_2$, ZnO or $AlO_3$ particles.

12. The method of forming a toner image of claim 10, wherein the interlayer contains anatase titanium oxide particles.

13. The method of forming a toner image of claim 10, wherein the interlayer contains metal oxide particles, and a number average diameter of primary particles of the metal oxide particles is from 4 to 400 nm.

14. A method of forming a toner image, comprising steps of:

electrically charging an electrophotographic photoreceptor by contacting a charging device to the photoreceptor;

imagewise exposing the photoreceptor so that a latent image is toned on the photoreceptor; and developing the latent image with toner so that a toner image is formed on the photoreceptor;

wherein the photoreceptor comprises an interlayer having a thickness of from 5 to 25 μm, the interlayer containing polyamide resin having a heat of fusion from 0 to 40 J/g and a water absorption degree of not more than 5% by weight, and the interlayer containing anatase titanium oxide particles containing niobium element in an amount of from 300 ppm to 1.8% by weight, a charge generation layer, and a charge transfer layer with a thickness of from 5 to 20 μm, each provided on an electroconductive substrate.

15. The method of forming a toner image of claim 14, wherein a thickness of the interlayer is from 7 to 15 μm.

* * * * *